US009016612B2

(12) United States Patent
Skarda

(10) Patent No.: US 9,016,612 B2
(45) Date of Patent: Apr. 28, 2015

(54) SIMULTANEOUS WINDING OF TISSUE WEBS

(75) Inventor: Jeffrey George Skarda, Broken Arrow, OK (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 782 days.

(21) Appl. No.: 13/237,176

(22) Filed: Sep. 20, 2011

(65) Prior Publication Data

US 2013/0068875 A1 Mar. 21, 2013

(51) Int. Cl.

| | |
|---|---|
| ***B65H 18/14*** | (2006.01) |
| ***B65H 18/02*** | (2006.01) |
| ***B65H 20/06*** | (2006.01) |
| ***B65H 23/038*** | (2006.01) |

(52) U.S. Cl.

CPC ..... *B65H 18/021* (2013.01); *B65H 20/06* (2013.01); *B65H 23/038* (2013.01); *B65H 2301/414323* (2013.01); *B65H 2301/44336* (2013.01); *B65H 2701/1864* (2013.01); *B65H 2701/1924* (2013.01)

(58) Field of Classification Search

USPC ..... 242/530, 530.2, 530.3, 530.4, 559.1, 242/559.2; 270/4, 5.01, 6, 7, 8, 9, 5.02, 270/5.03, 10–17, 52.07, 52.08, 52.11

See application file for complete search history.

(56) References Cited

U.S. PATENT DOCUMENTS

| | | | | |
|---|---|---|---|---|
| 2,641,416 | A * | 6/1953 | McCleary et al. | 242/563.1 |
| 3,284,077 | A * | 11/1966 | Matuschke | 270/5.03 |
| 3,470,052 | A | 9/1969 | Herman | |
| 3,802,693 | A * | 4/1974 | Grachev et al. | 270/6 |
| RE28,353 | E | 3/1975 | Nytsrand et al. | |
| 3,897,727 | A | 8/1975 | Fulk | |
| 4,181,270 | A | 1/1980 | Laar et al. | |
| 4,191,341 | A | 3/1980 | Looser | |
| 4,858,842 | A | 8/1989 | Mundus | |
| 6,059,219 | A | 5/2000 | Kayser et al. | |
| 6,375,605 | B1 | 4/2002 | Niedermeyer | |
| 6,387,220 | B1 | 5/2002 | Mohrsen et al. | |
| 6,425,512 | B2 | 7/2002 | Hill et al. | |
| 6,440,268 | B1 | 8/2002 | Baggot et al. | |

(Continued)

FOREIGN PATENT DOCUMENTS

| | | |
|---|---|---|
| GB | 1177431 | 1/1970 |
| JP | 11-147636 | 6/1999 |

(Continued)

OTHER PUBLICATIONS

International Search Report for PCT/IB2012/054117, dated Mar. 8, 2013.

*Primary Examiner* — William A Rivera
(74) *Attorney, Agent, or Firm* — Dority & Manning, PA

(57) ABSTRACT

A system and process is described for producing spirally wound products. According to the process of the present disclosure, two or more webs are conveyed together in a superimposed relationship. The webs are then separated such that one web goes to a first winding module while a second web goes to a second winding module, etc. In this manner, at least two spirally wound products can be produced simultaneously. The process and system of the present disclosure are particularly well suited for processing tissue webs, such as paper towels and bath tissue. The process of the present disclosure can effectively at least double throughput on existing winding systems.

21 Claims, 11 Drawing Sheets

(56) References Cited

U.S. PATENT DOCUMENTS

| | | | | |
|---|---|---|---|---|
| 6,533,213 | B2 * | 3/2003 | Durrance et al. | 242/560.1 |
| 6,592,693 | B1 | 7/2003 | Nedblake | |
| 6,709,549 | B2 | 3/2004 | Berglund et al. | |
| 6,733,608 | B1 | 5/2004 | Baggot et al. | |
| 7,029,001 | B2 * | 4/2006 | Crum | 270/52.08 |
| 7,175,172 | B2 | 2/2007 | Steinborn et al. | |
| 7,384,491 | B2 | 6/2008 | Fitts, Jr. et al. | |
| 7,909,282 | B2 | 3/2011 | Wojcik et al. | |
| 8,042,761 | B2 | 10/2011 | Wojcik et al. | |
| 8,210,462 | B2 | 7/2012 | Wojcik et al. | |
| 8,757,609 | B2 * | 6/2014 | Dalal et al. | 270/52.13 |
| 2003/0160127 | A1 | 8/2003 | Wojcik et al. | |
| 2008/0048062 | A1 | 2/2008 | Wojcik et al. | |
| 2008/0105776 | A1 | 5/2008 | Wojcik et al. | |
| 2008/0149756 | A1 | 6/2008 | Kuwabara | |
| 2008/0258372 | A1 * | 10/2008 | Nakane et al. | 270/58.08 |
| 2010/0101185 | A1 | 4/2010 | Maddaleni et al. | |
| 2011/0057068 | A1 | 3/2011 | Baggot et al. | |

FOREIGN PATENT DOCUMENTS

| | | |
|---|---|---|
| JP | 2005-001879 | 1/2005 |
| WO | 2009/051761 A2 | 4/2009 |

* cited by examiner

SIMULTANEOUS WINDING OF TISSUE WEBS

BACKGROUND

Winders are machines that roll lengths of paper, such as tissue webs, into rolls. These machines are capable of rolling lengths of web into rolls at high speeds through an automated process. Turret winders are well known in the art. Conventional turret winders comprise a rotating turret assembly which support a plurality of mandrels for rotation about a turret axis. The mandrels travel in a circular path at a fixed distance from the turret axis. The mandrels engage hollow cores upon which a paper web can be wound. Typically, the paper web is unwound from a parent roll in a continuous fashion, and the turret winder rewinds the paper web onto the cores supported on the mandrels to provide individual, relatively small diameter logs. The rolled product log is then cut to designated lengths into the final product. Final products typically created by these machines and processes are toilet tissue rolls, paper toweling rolls, and the like.

The winding technique used in turret winders is known as center winding. A center winding apparatus, for instance, is disclosed in U.S. Pat. Reissue No. 28,353 to Nystrand, which is incorporated herein by reference. In center winding, a mandrel is rotated in order to wind a web into a roll/log, either with or without a core. Typically, the core is mounted on a mandrel that rotates at high speeds at the beginning of a winding cycle and then slows down as the size of the rolled product being wound increases, in order to maintain a constant surface speed, approximately matching web speed.

A second type of winding is known in the art as surface winding. Typically, in surface winding, the web is wound onto the core via contact and friction developed with rotating rollers. A nip is typically formed between two or more co-acting roller systems. In surface winding, the core and the web that is wound around the core are usually driven by rotating rollers that operate at approximately the same speed as the web speed.

Recently, a winding system was developed that can use both center winding and surface winding either alone or in combination. Such a winding system, for instance, is disclosed in U.S. Patent Application Publication No. 2011/0057068; U.S. Patent Application Publication No. 2008/0105776; U.S. Patent Application Publication No. 2003/0160127; and U.S. Pat. No. 7,909,282; which are incorporated herein by reference. The winding systems described in the above references have provided many advancements in the art. The above winding systems, for instance, can operate at very fast speeds and are capable of quickly reacting to unintended web breaks or faults.

A need still remains, however, for further improvements and advancements in the art for increasing winding speeds and/or increasing throughput.

SUMMARY

The present disclosure is generally directed to an improved method and system for producing spirally wound products. The wound products may comprise, for instance, tissue products, such as bath tissue and paper towels. In general, the present disclosure is directed to simultaneously winding multiple tissue sheets for increasing productivity.

In one embodiment, for instance, the present disclosure is directed to a method for forming spirally wound rolls. The method includes placing a first tissue web on top of a second tissue web. The first tissue web and the second tissue web are conveyed downstream in a superimposed relationship. The first tissue web is then separated from the second tissue web and fed to a first winding device while the second tissue web is simultaneously fed to a second winding device. The first tissue web is wound on the first winding device and the second tissue web is wound on the second winding device simultaneously to form respective spirally wound rolls.

In the embodiment described above, two tissue webs are conveyed downstream in a superimposed relationship. In other embodiments, however, more than two webs may be conveyed simultaneously. For example, in an alternative embodiment, a third tissue web may be placed on top of the first tissue web and on top of the second tissue web. The three tissue webs can then be conveyed downstream in a superimposed relationship. The third tissue web may be separated from the other two webs and fed to a third winding device. In this manner, three spirally wound rolls may be formed simultaneously.

Although optional, in one embodiment, especially when conveying the tissue webs at higher speeds, it may be advantageous to hold the tissue webs together in a removable manner. Holding the tissue webs together as they are conveyed in a superimposed relationship, however, may prevent one or more of the tissue webs from separating during the process.

In one embodiment, for instance, an electrostatic force can be induced in one or both of the webs for causing the webs to bond together prior to separating and forming the spirally wound rolls. In an alternative embodiment, the first tissue web and the second tissue web can be conveyed downstream by a conveying device that applies a suction force to the tissue webs. The first tissue web can be positioned offset with respect to the second tissue web on the conveying device such that a leading edge of the first tissue web overlaps and extends beyond a leading edge of the second tissue web. In this manner, the suction force being applied by the conveying device holds both webs against the conveying device as the webs are conveyed at high speeds.

While the first tissue web and the second tissue web are being wound into rolls, various converting operations can be carried out on the webs. For instance, in one embodiment, each tissue web can be periodically perforated to form cross-directional perforation lines on each web. The tissue webs can also be calendered and can be periodically cut as the spirally wound rolls are formed so as to begin a new roll. All of these operations can occur separately on each web or can occur simultaneously to both webs when the webs are in a superimposed relationship.

The present disclosure is also directed to a system for forming spirally wound rolls. The system includes a first unwind device for unwinding a first tissue web and a second unwind device for unwinding a second tissue web. The system further includes a web transport apparatus for conveying the first tissue web and the second tissue web downstream from the unwind stations. The web transport apparatus is configured to receive the first tissue web and the second tissue web simultaneously in a superimposed relationship.

The system includes a plurality of winding modules positioned along the web transport apparatus. In particular, the system includes at least a first winding module for receiving the first tissue web and a second winding module for receiving the second tissue web. The winding modules simultaneously form spirally wound rolls from their respective tissue webs.

Optionally, the system can include at least one perforation station for forming cross-directional perforation lines at periodic intervals on the tissue webs. The system can include at least one cutting device positioned upstream from the winding modules for cutting the tissue webs periodically as the spirally wound rolls are formed.

Other features and aspects of the present disclosure are discussed in greater detail below.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

Figure 1:
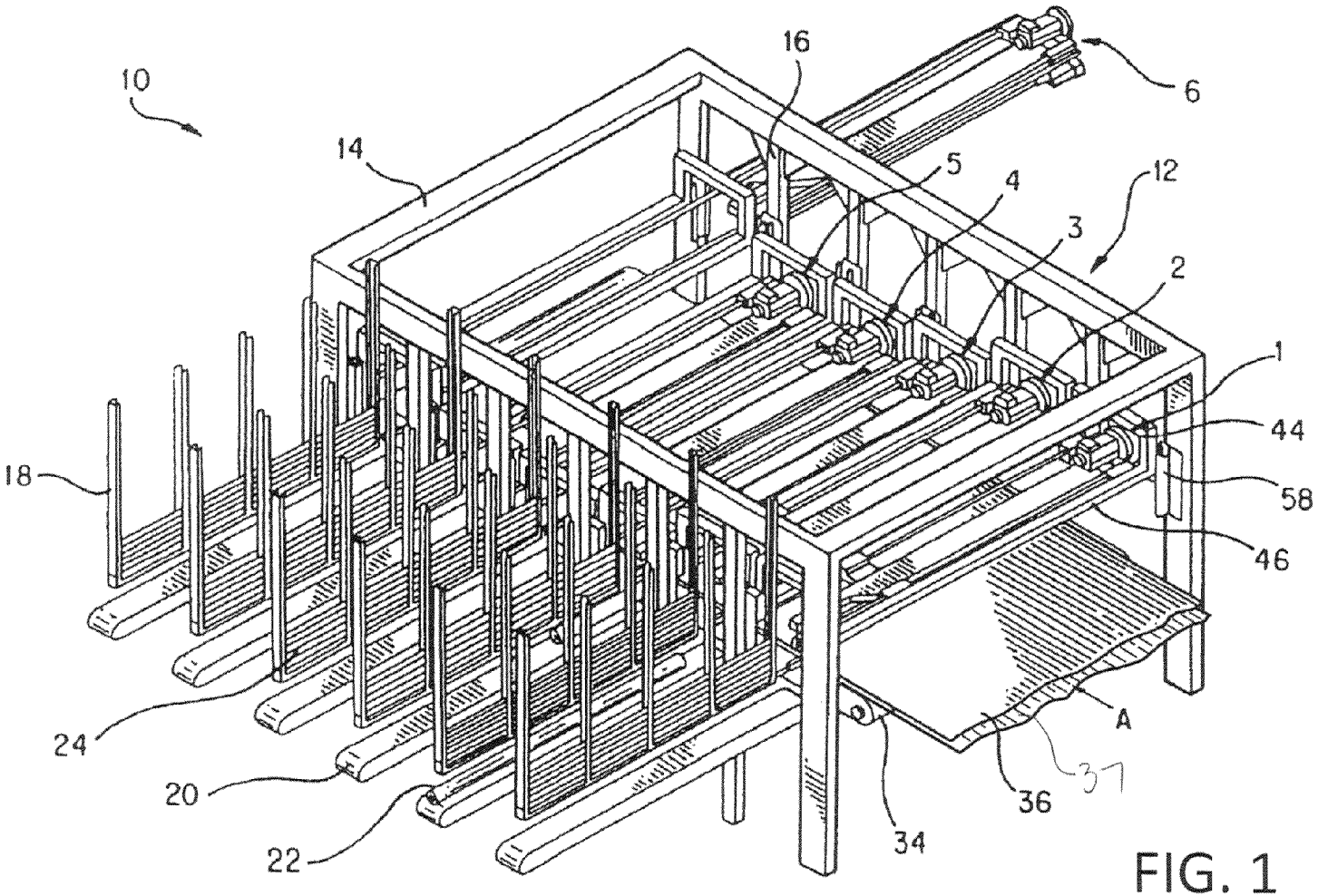
FIG. 1 is one embodiment of a system that may be used in accordance with the present disclosure.

Repeat use of reference characters in the present specification and drawings is intended to represent the same or analogous features or elements of the present invention.

DETAILED DESCRIPTION

It is to be understood by one of ordinary skill in the art that the present discussion is a description of exemplary embodiments only, and is not intended as limiting the broader aspects of the present disclosure.

The present disclosure is generally directed to a process and system for forming spirally wound products, such as bath tissue and paper towels. In accordance with the present disclosure, two sheet products are superimposed on one another and fed simultaneously to two winding devices for forming the products.

In the past, those skilled in the art have continually attempted to increase process line speeds of winding operations without adversely interfering with the product. Typically, when wind speeds are increased, however, other issues arise that relate to the handling of the sheet and/or other process consequences. Thus, in the past in order to allow for an incremental improvement in productivity by increasing wind speeds, a significant amount of engineering time and investment was required so that the product was not adversely impacted.

According to the present disclosure, however, productivity is greatly increased without having to increase line or machine speeds. In this regard, the present disclosure is directed to producing spirally wound products by processing multiple sheets together. For example, two sheet products, such as two tissue products, can be placed in a superimposed relationship and threaded through a winding process utilizing separate winding modules. Each sheet product is fed to a separate winding module allowing for both sheets to be wound simultaneously. Operating two sheets together effectively doubles the throughput capability of a processing line.

In addition to threading two tissue sheets together through the winding process, in other embodiments, more than two tissue sheets may be processed simultaneously. For example, the teachings of the present disclosure can also be directed to simultaneously winding more than two tissue sheets at the same time. For instance, in one embodiment, at least three tissue webs, such as at least four tissue webs, such as even at least five tissue webs may be placed in a superimposed relationship and conveyed through the winding process and then fed to separate winding modules for producing wound products.

While the multiple sheet products are being wound into spirally wound rolls, the sheet products can undergo various converting operations. For instance, the system can include a perforation station for perforating the sheets periodically, can include cutting devices for cutting the sheets once a rolled product is formed, can include calendering stations, and the like. The above stations and devices can be designed to process the sheet products simultaneously or to process the sheet products individually.

When producing rolled products in accordance with the present disclosure, the two or more superimposed sheet products are conveyed on a conveying device and then fed to different winding modules. For example, when conveying two sheets together, the top sheet can be transferred to a first winding module while the bottom sheet is further conveyed downstream to a second winding module.

Figure 2:
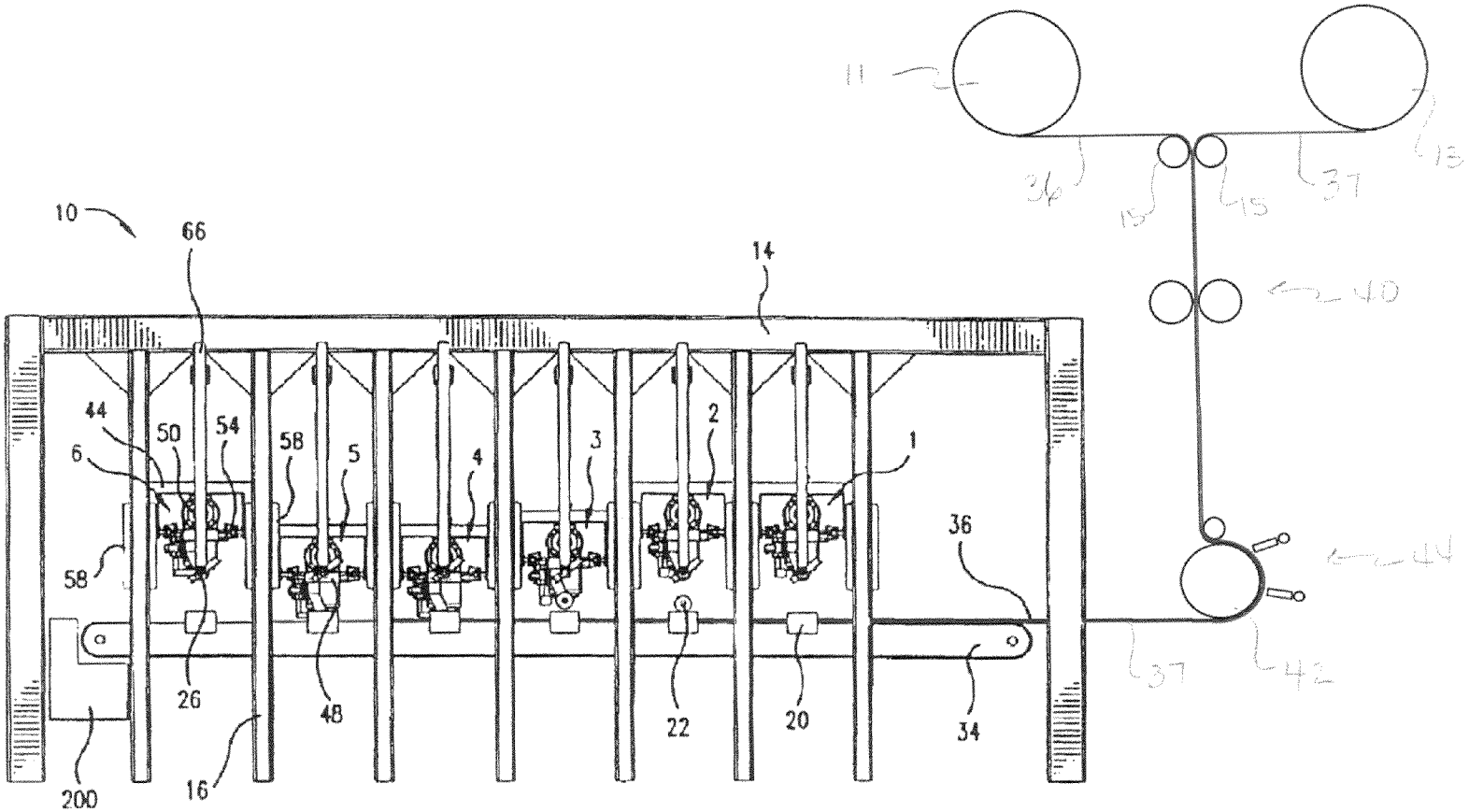
FIG. 2 is a side view of the system illustrated in FIG. 1.

Referring to FIGS. 1 and 2, one embodiment of a system for spirally winding sheet products in accordance with the present disclosure is shown. The system illustrated in FIGS. 1 and 2 is similar to a winding system described in U.S. Patent Publication No. 2008/0105776, which is incorporated herein by reference.

As shown in FIGS. 1 and 2, the system 10 is configured to receive multiple webs simultaneously for forming spirally wound roll products from the webs. In the embodiment illustrated, for instance, a first tissue web 36 and a second tissue web 37 are fed to the winder system 10 simultaneously in a superimposed relationship. In the embodiment illustrated in FIG. 2, the first tissue web 36 is fed from a first parent roll 11, while the second tissue web 37 is fed into the system 10 from a second parent roll 13. Thus, in the embodiment illustrated in FIG. 2, system 10 is for unwinding previously formed tissue webs and forming rolled products. In an alternative embodiment, however, the system 10 can be positioned so as to receive the tissue webs as they are exiting a process line where the webs are formed.

In the embodiment illustrated in the figures, a first tissue web and a second tissue web are simultaneously fed to the winder system in a superimposed relationship. It should be understood, however, that more than two webs can also be fed together through the winder system. When feeding more than two webs together into the winder system, each web will go to a separate and corresponding winding module as will be described in greater detail below.

As shown in FIGS. 1 and 2, the winding system 10 includes a plurality of independent winding modules 12 for receiving the tissue webs and forming the rolled products. The winding modules 12 are each positioned along a web transport apparatus 34 comprising a conveying device, such as a conveyor. In the embodiment illustrated, the winding modules 12 are positioned along the web transport apparatus 34 in a linear relationship. In an alternative embodiment, however, the winding modules 12 may be positioned in a radial relationship, such as in a turret winding system.

A frame 14 supports the plurality of independent winding modules 12. The web transport apparatus 34 transports the tissue webs 36 and 37 simultaneously in a superimposed relationship for eventual contact with respective winding modules for forming two rolled products at the same time. The frame 14 is composed of a plurality of posts 16 onto which the plurality of independent winding modules are engaged and supported. In the figure, the winding modules are slidably mounted onto the frame 14.

Situated adjacent to the frame 14 are a series of core supplying apparatuses 18. A plurality of cores 24 may be included within each core supplying apparatus 18. These cores 24 may be used by the plurality of independent winding modules 12 to form rolled products 22. In an alternative embodiment, however, the wound products being formed may be coreless. Once formed, the rolled products 22 may be removed from the plurality of independent winding modules 12 and placed onto a rolled product transport apparatus 20. The product transport apparatus 20 is located proximate to the frame 14 and the web transport apparatus 34.

As shown in FIG. 2, in accordance with the present disclosure, the first tissue web 36 is unwound from the first parent roll 11 using a first unwind device while the second tissue web 37 is unwound from a second parent roll 13 by a second unwind device. The first tissue web 36 and the second tissue web 37 are brought together in a superimposed relationship. For instance, each of the webs can contact a draw roll 15 and brought together in a superimposed relationship.

Once the first tissue web 36 and the second tissue web 37 are brought together, the tissue webs can undergo various converting processes. In the embodiment illustrated in FIG. 2, for instance, the tissue webs 36 and 37 are fed through a perforation station 40. The perforation station 40 perforates the tissue webs simultaneously. In particular, the perforation station applies perforation lines to the tissue webs perpendicular to the moving direction or machine direction of the webs. The perforation lines are applied periodically to the tissue webs at regular intervals to form individual tissue sheets within the resulting wound product.

In addition to a perforation station, various other converting processes can also be placed within the processing line. For example, in other embodiments, a calendering device may calender the webs. In other embodiments, an additive composition may also be sprayed onto the webs during the process. The additive composition, for instance, may comprise a softener, an antiviral agent, or a friction reducing agent.

In the embodiment illustrated in FIG. 2, after being perforated, the tissue webs 36 and 37 are fed to a vacuum roll 42 prior to contacting the web transport apparatus 34. Adjacent to the vacuum roll 42 is a cutting device 44 for periodically cutting the webs 36 and 37 when finished rolls have been produced downstream. The cutting device 44 can be configured to cut both tissue webs simultaneously.

In the embodiment illustrated in FIG. 2, the tissue webs are fed to a vacuum roll prior to contacting the web transport apparatus. In an alternative embodiment, however, the vacuum roll 42 may be unnecessary. Instead, the tissue webs may be fed directly to the web transport apparatus. In this embodiment, the cutting device 44 can be positioned adjacent the web transport apparatus for cutting the webs when desired.

Once the tissue webs 36 and 37 are fed onto the web transport apparatus 34, the webs are engaged by respective winding modules. In the embodiment illustrated in FIG. 2, for instance, the first tissue web 36 is fed to a winding module 4, while the second tissue web 37 is fed to a winding module 5. The winding modules 4 and 5 include a rotating mandrel that winds the web thereon. The winding modules are configured to produce rolled products. Once the products have obtained a desired size, the cutting device 44 cuts the tissue webs producing leading edges that are then fed to different winding modules within the system 10 for producing further rolled products.

Referring now to FIGS. 7 through 11, one embodiment of a process for winding a tissue web on a mandrel that is part of one of the winding modules will now be described in greater detail. During the process of the present disclosure, two or more rolls of product are formed simultaneously such as by the process shown in FIGS. 7 through 11.

Figure 7:
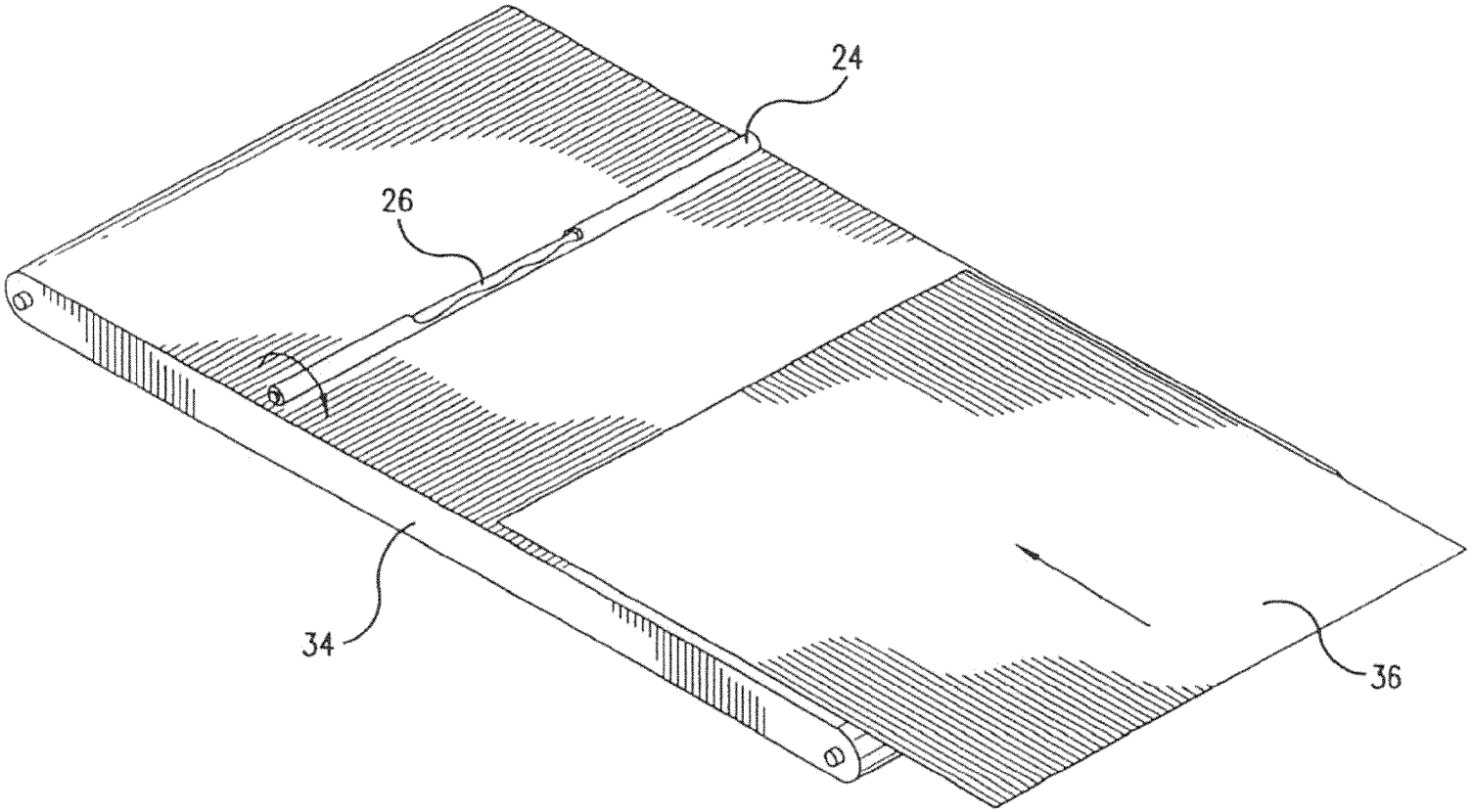
FIGS. 7 through 11 are perspective views of one embodiment of sequential sequences for forming a spirally wound roll in accordance with the present disclosure.

Referring to FIG. 7, a leading edge of the first tissue web 36 is shown being wound onto a core 24. The winding of the tissue web 36 onto the core 24 can be controlled by pressing the core 24 onto the web transport apparatus 34 to form a nip. The magnitude with which the core 24 is pressed onto the web transport apparatus 34 creates a nip pressure that can control the winding of the web 36 onto the core 24. In order to initiate winding onto the core 24, the core can be treated with an adhesive using an adhesive applicator. The adhesive applicator, for instance, may be incorporated into the winding module.

In an alternative embodiment, the web 36 can be wound onto the mandrel 26 without the use of a core. In this embodiment, the mandrel 26 may be vacuum supplied. A vacuum mandrel pulls the web 36 onto the mandrel by means of a suction force. For example, the mandrel 26 may include a plurality of passageways by which the suction force is applied to the web.

The incoming tension of the tissue web 36 can also be controlled during the process in order to effect the winding of the web onto the core.

In one embodiment, prior to contacting the leading edge of the tissue web 36 with the core 24, the mandrel 26 may be rotated to a desired rotational speed while positioned adjacent to the web transport apparatus for contact with the tissue web. The rotational speed of the mandrel and the position of the winding module with respect to the tissue web may be controlled so that the web winds on the core in a uniform manner. In one embodiment, for instance, the mandrel 26 may be rotated to a speed that substantially matches the speed at which the tissue web 36 is moving on the web transport apparatus.

Once winding is initiated on the core 24, further winding can occur by center winding (i.e. rotating the mandrel 26), surface winding (by forming a nip between the web transport apparatus and the roll being formed) or through a combination of center and surface winding.

When winding includes center winding, the torque of the driven mandrel 26 can be controlled and varied in order to control various properties of the wound product. In fact, during winding, the nip magnitude, the tension of the web, and the torque differential can all be adjusted to produce a product with the desired characteristics.

Once a rolled product is formed having a desired length, the tissue web 36 is then cut using a cutting device, such as the cutting device 44 illustrated in FIG. 2. Cutting the tissue webs 36 and 37 produces new leading edges that are then fed to other winding modules within the system.

Figure 8:
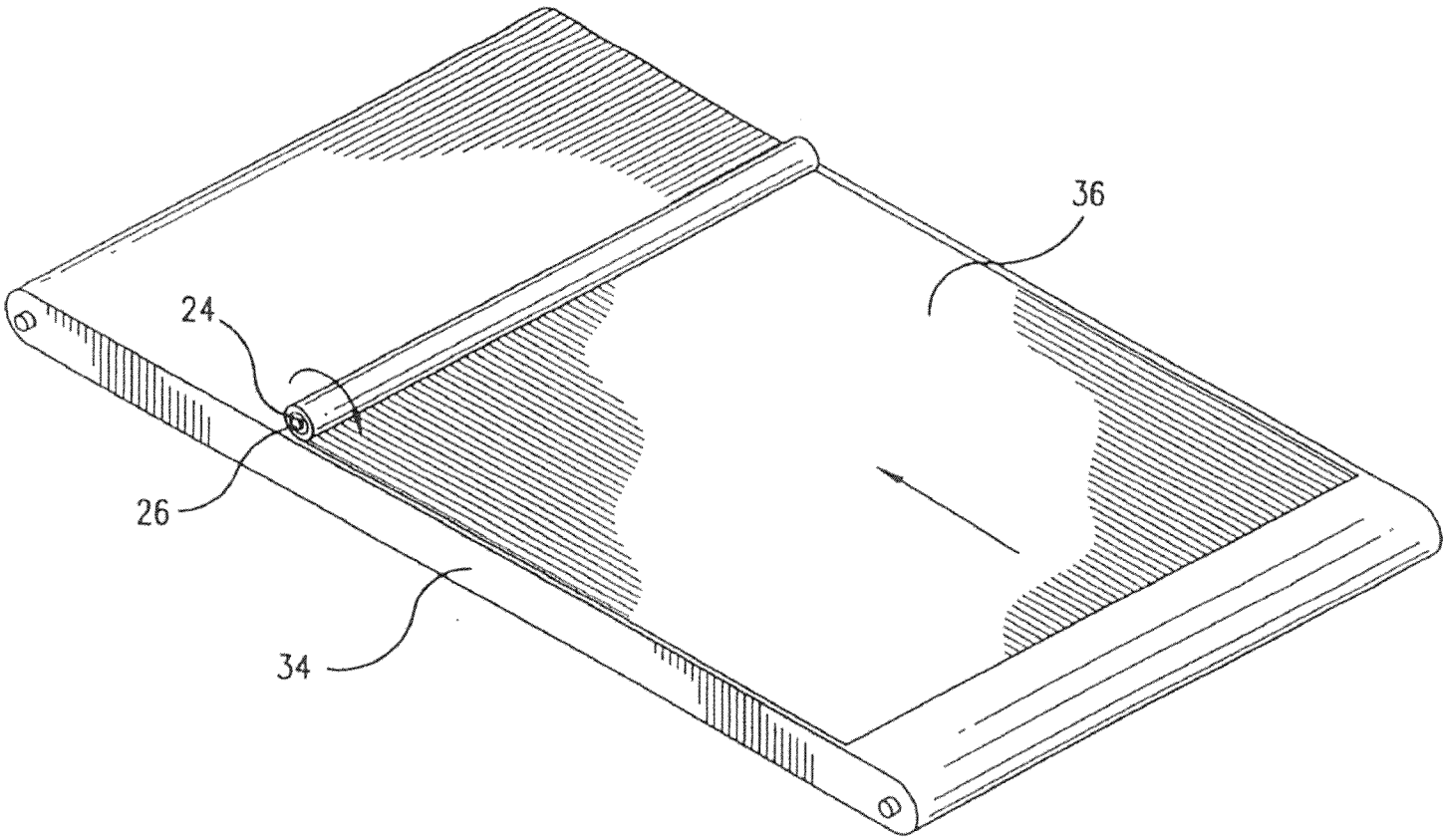

FIG. 8 illustrates a spirally wound product that has been formed on the core 24. As shown, the tissue web 36 has been cut and the trailing edge is fed to the mandrel. Not shown, the winding system or each individual winding module may include a tail sealing apparatus. The tail sealing apparatus may spray or otherwise apply an adhesive adjacent to the trailing edge of the tissue web 36. The adhesive causes the tailing end of the web 36 to be adhered to the rolled product.

Figure 9:
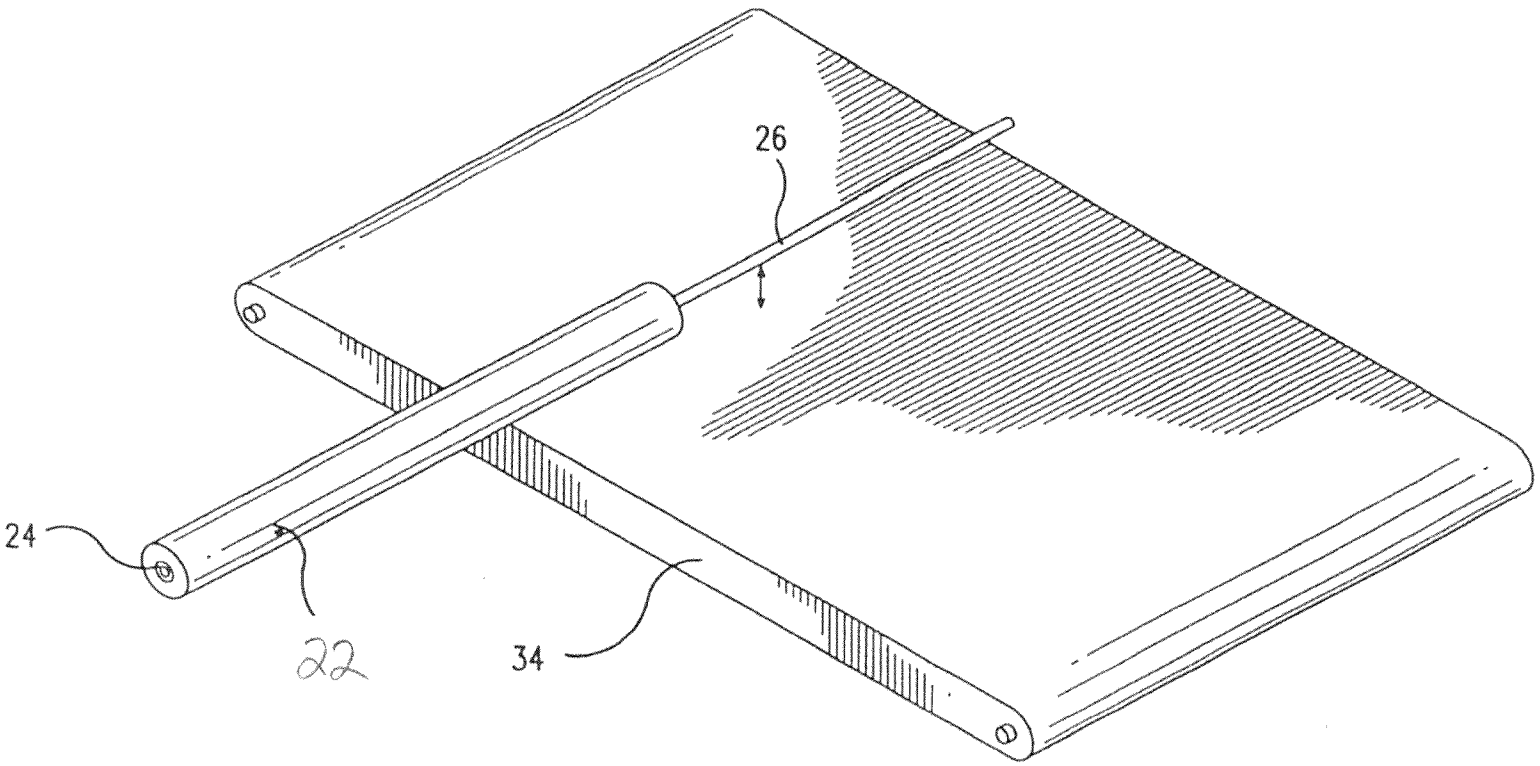

Once a spirally wound product 22 is formed on the mandrel, the product is stripped from the mandrel. For instance, as shown in FIG. 9, once the wound roll 22 is finished, the mandrel 26 can be moved out of contact with the web transport apparatus 34 and a stripping function is carried out that moves the rolled product 22 off the mandrel 26. Any suitable product stripping apparatus may be utilized to remove the rolled product 22 from the mandrel 26. In one embodiment, the stripping apparatus can be part of the winding module. As shown in FIG. 1, in one embodiment, the finished product can be fed onto the rolled product transport apparatus 20 for further processing and packaging.

Figure 10:
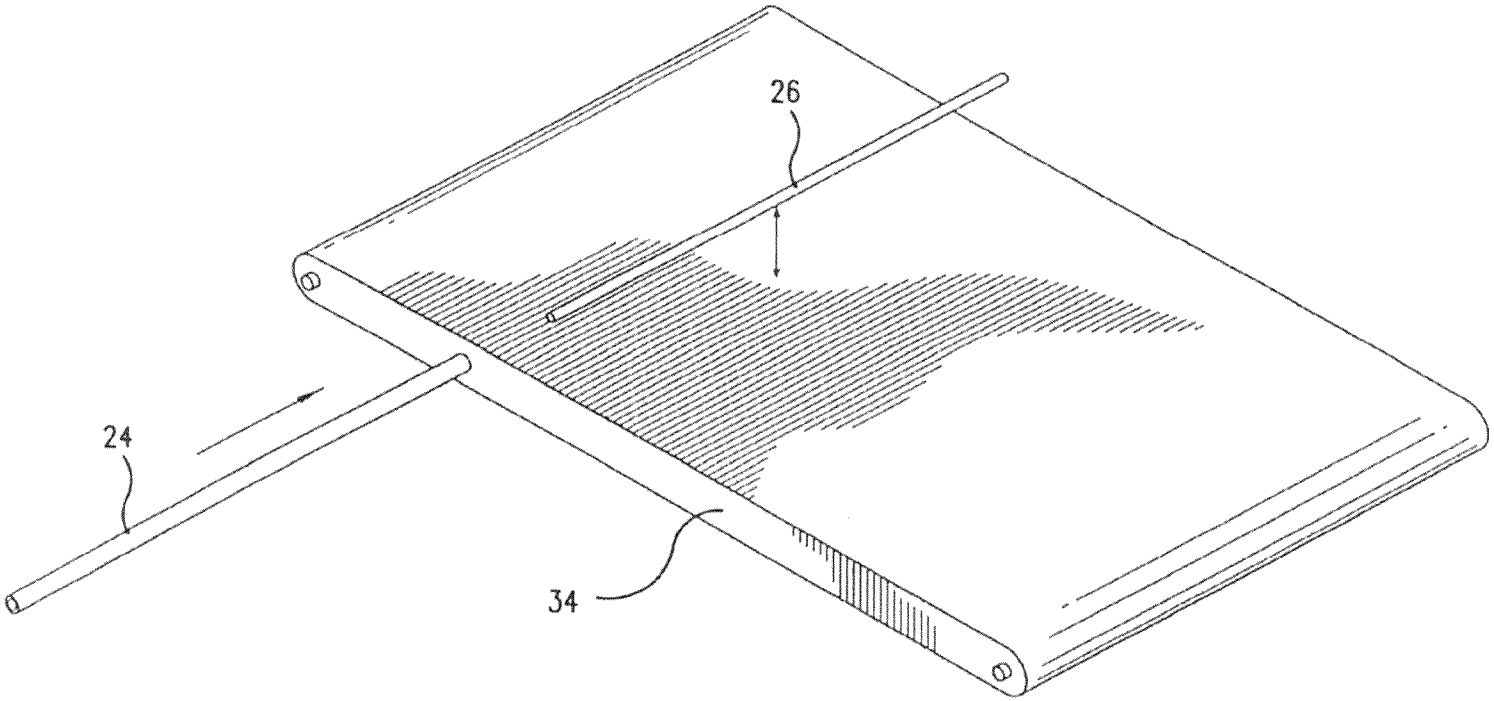
Figure 11:
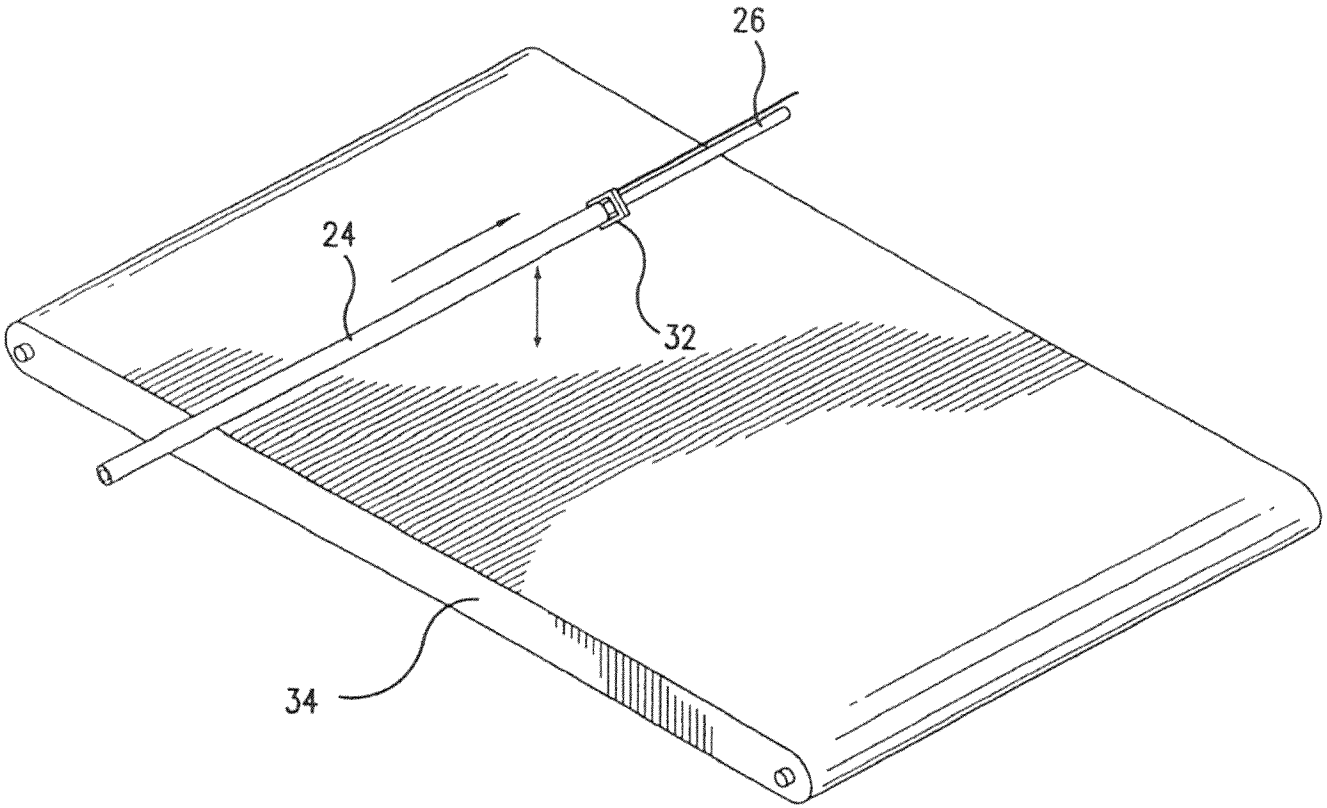

Referring to FIG. 10, a core 24 is shown being loaded back onto the mandrel 26. The core 24 can be fed onto the mandrel 26 using any suitable core loading apparatus. In one embodiment, the product stripping apparatus may also serve as the core loading apparatus. For example, in FIG. 11, one embodiment of a core loading apparatus and a product stripping apparatus 32 is shown.

Referring to FIGS. 1 and 2, the winding system 10 can include a plurality of winding modules 12. In the embodiment illustrated, the system includes six winding modules having character reference numerals 1, 2, 3, 4, 5 and 6. It should be understood, however, that the winding system may include more or less winding modules as desired. In accordance with the present disclosure, the system 10 includes at least two winding modules so that at least two tissue webs can be wound simultaneously.

Having a greater number of winding modules may be advantageous. For instance, while two winding modules are winding webs, two other winding modules can be loaded with cores for winding the next products. Two other winding modules may have finished winding and are in the process of stripping wound products. Having multiple pairs of winding modules allows for the production of wound products in a continuous process without halting the unwinding of the webs from the parent rolls 11 and 13.

Figure 4:
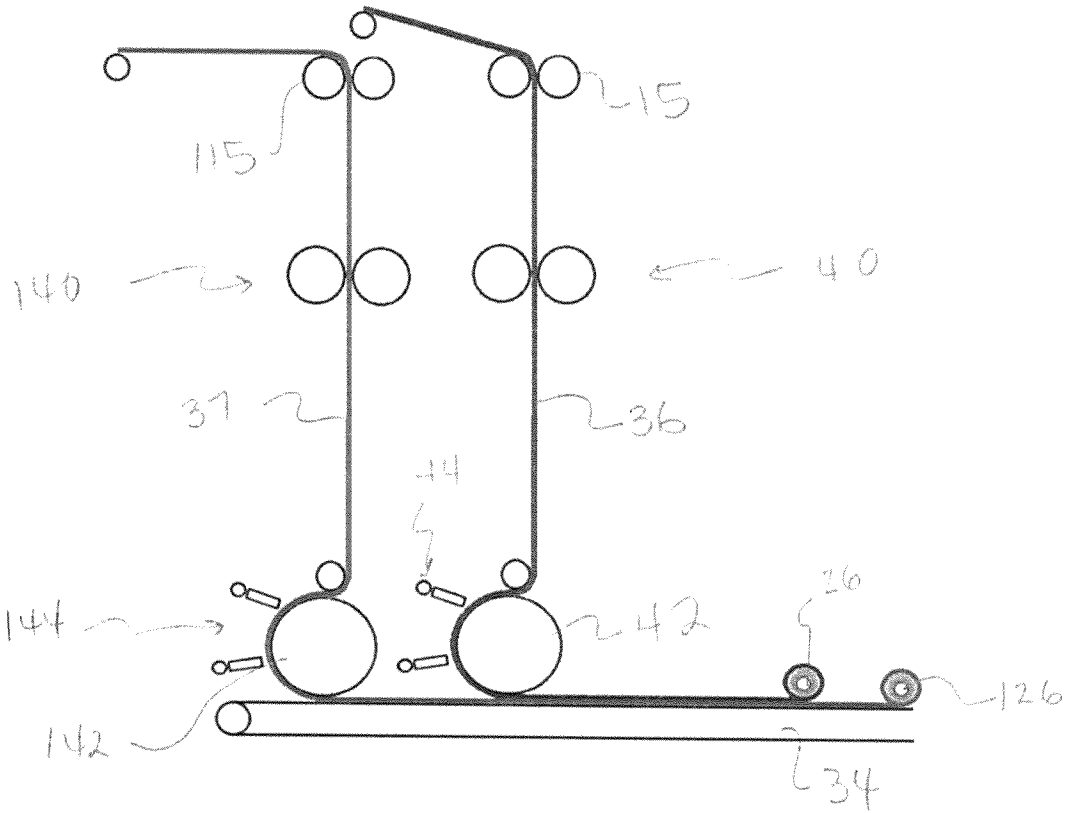
FIG. 4 is a side view of an alternative embodiment of a system made in accordance with the present disclosure.

Referring to FIG. 4, another alternative embodiment of a winding system made in accordance with the present disclosure is illustrated. Repeat use of reference characters have been used in order to indicate the same or similar elements. As shown in FIG. 4, in this embodiment, the first tissue web 36 and the second tissue web 37 are fed separately to the web transport apparatus 34. In particular, as shown, the first tissue web 36 is fed through draw rolls 15 and through a perforation station 40 prior to being placed on a vacuum roll 42. The vacuum roll 42 is shown in conjunction with a cutting device 44. From the vacuum roll 42, the first tissue web 36 is placed on top of a second tissue web 37 on the web transport apparatus 34 for winding on a mandrel 26.

The second tissue web 37 is also similarly fed through draw rolls 115 and a perforation station 140 prior to being contacted with a vacuum roll 142. The vacuum roll 142 is placed in communication with a cutting device 144. From the vacuum roll 142, the second tissue web 37 is placed on the web transport apparatus 34. Once placed on the web transport apparatus, the second tissue web is placed in a superimposed relationship with the first tissue web 36 prior to being fed to a mandrel 126. The mandrel 26 and the mandrel 126 simultaneously form spirally wound products as the tissue webs 36 and 37 are fed to the process.

In the embodiment illustrated in FIG. 4, each tissue web is perforated individually prior to being placed in a superimposed relationship. Further, the cutting devices 44 and 144 cut each tissue web independently of the other. In this manner, the rolled products that are formed from each tissue web can vary. For example, the sheet length created by the perforation stations 40 and 140 can vary between the two tissue webs. In addition, having two cutting devices 44 and 144 allows for the production of rolled products having different sheet lengths.

Figure 3:
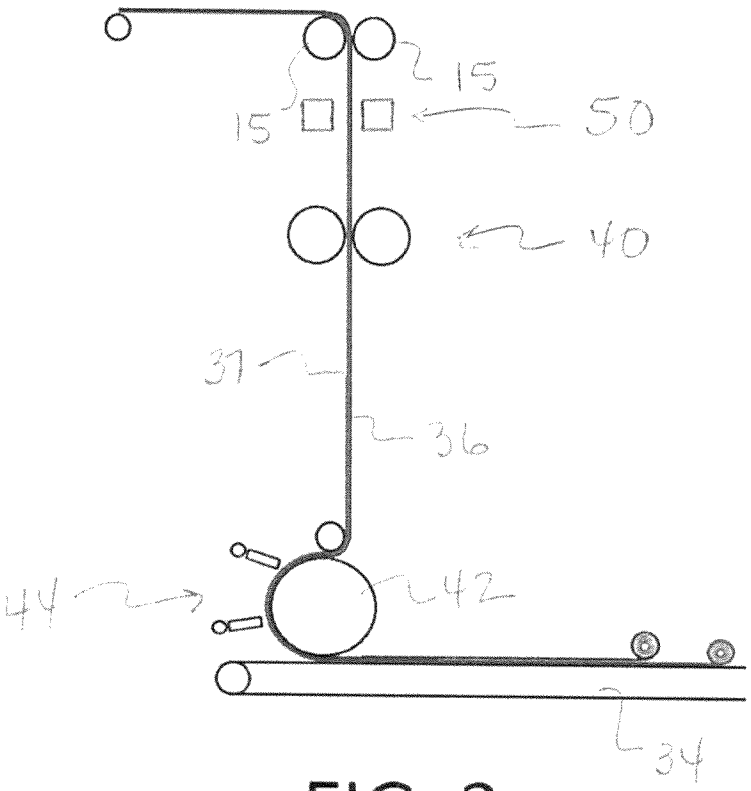
FIG. 3 is a side view of one portion of the system illustrated in FIG. 2.

In conveying two or more tissue webs in a superimposed relationship on the web transport apparatus, problems may arise with respect to proper sheet handling of the leading edges of the tissue web after the webs have been cut. For instance, due to the speed of the process, the top tissue web may have a tendency to fly back due to air disturbances. In particular, as the plurality of webs are conveyed down the web transport apparatus, air may tend to separate the webs causing the top tissue web to fly backwards. Thus, in one embodiment, if necessary, the first tissue web 36 and the second tissue web 37 can be removably bonded together as the webs are conveyed down the web transport apparatus 34. Referring to FIG. 3, for instance, one embodiment of a system for causing removable bonding to occur between the two webs is shown. In particular, in FIG. 3, the winding system includes a static induction device 50. The static induction device 50 applies opposing static charges to each of the tissue webs or applies a static charge to at least one of the webs that causes a static bond to be formed between the webs. The level of static charge can be controlled to ensure enough bonding is present to allow for proper sheet handling while still allowing the top tissue web to separate from the bottom tissue web when contacted with a winding module.

Figure 5:
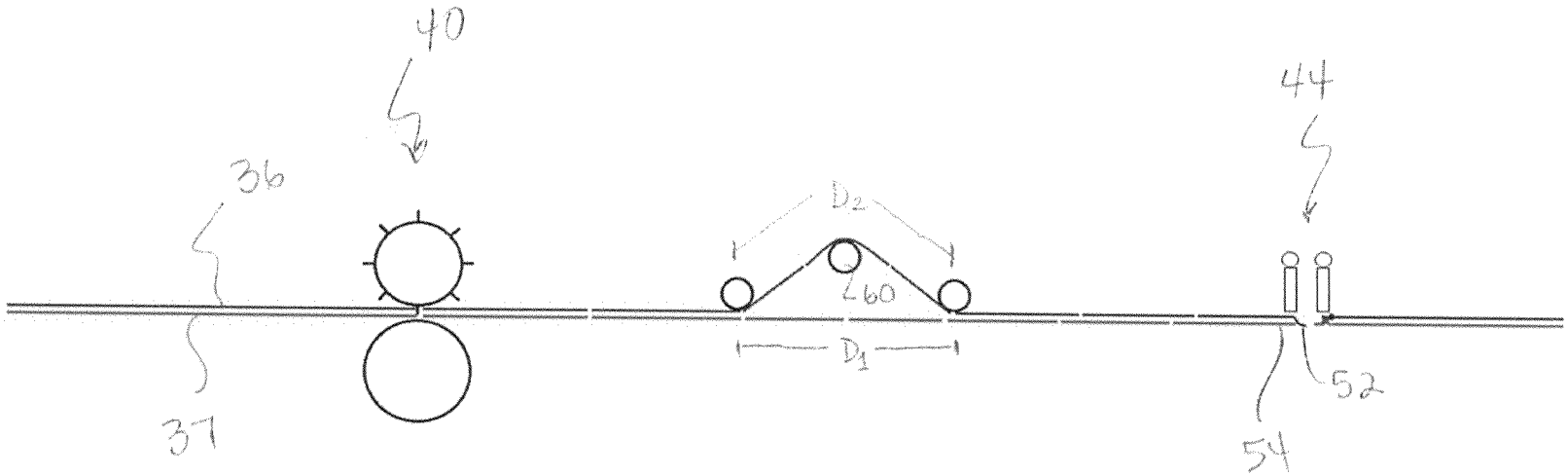
FIG. 5 is a side view of still another embodiment of a system made in accordance with the present disclosure.
Figure 6:
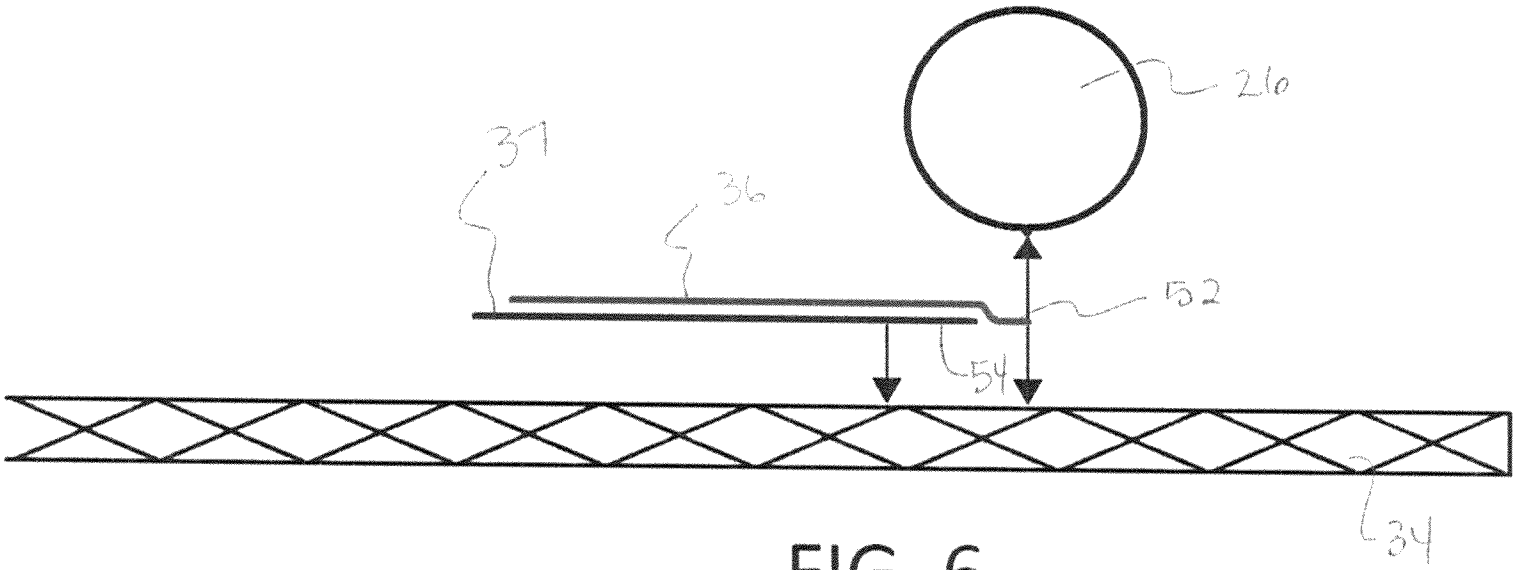
FIG. 6 is a side view of a portion of a system made in accordance with the present disclosure.

Referring now to FIGS. 5 and 6, another method for maintaining the tissue webs 36 and 37 in a superimposed relationship is shown. FIG. 5, for instance, shows the first tissue web 36 and the second tissue web 37 being fed through a perforation station 40. In FIG. 5, a cutting device 44 is also shown that periodically cuts the tissue webs once spirally wound products are formed.

Referring to FIG. 6, the first tissue web 36 and the second tissue web 37 are shown being conveyed on the web transport apparatus 34. In the embodiment illustrated in FIGS. 5 and 6, the web transport apparatus 34 comprises a vacuum transport conveyor that applies a suction force to both plies of the tissue webs as the webs are being conveyed. As shown in FIG. 6, the first tissue web 36 includes a first leading edge 52, while the second tissue web 37 includes a second leading edge 54. In order to improve handling of the tissue webs in a superimposed relationship, in this embodiment, the first tissue web 36 is positioned offset from the second tissue web 37 such that the leading edge 52 of the first tissue web 36 overlaps and extends beyond the leading edge 54 of the second tissue web 37. In this manner, the leading edge 52 of the first tissue web 36 is directly exposed to the suction force created by the web transport apparatus 34. In this manner, the suction force is sufficient to hold down the top tissue web as both webs are conveyed at a fast speed. Further, offsetting the leading edge 52 of the first tissue web 36 from the leading edge 54 of the second tissue web 37 may assist in transferring the tissue webs to separate winding modules. In particular, offsetting the leading edge 52 may minimize the likelihood that both tissue webs will transfer to a single winding module.

As shown in FIG. 6, a mandrel 26 of a winding module is shown in the drawing. The mandrel 26 may comprise a vacuum mandrel or may be covered by a core that includes an adhesive bead. In accordance with the present disclosure, the leading edge 52 of the first tissue web 36 contacts the mandrel 26 or a core placed on the mandrel which then initiates winding of the first tissue web 36. The second tissue web 37 is then conveyed downstream on the web transport apparatus 34 and contacted with a second winding module.

There are various methods and techniques that may be used in order to cause the tissue webs to be offset from one another as shown in FIG. 6. One method, for instance, is illustrated in FIG. 5. In FIG. 5, for instance, the travel paths of both tissue webs are varied that create an offset when the webs are cut using the cutting device 44. As shown, for instance, the first tissue web 36 follows a first travel path that includes a distance D2. The second tissue web 37, on the other hand, follows a second travel path that includes a distance D1. By having the first travel path D2 be longer than the first travel path D1, an offset is created. In particular, the offset between the tissue webs is a function of the web travel paths. In particular, the offset created between the two webs is equal to the distance D2 minus the distance D1.

In the embodiment illustrated in FIG. 5, the travel paths can also be adjusted and controlled by changing the position of a roller 60. The roller 60, for instance, can be moved towards and away from the web transport apparatus for increasing or decreasing the amount of offset.

In an alternative embodiment, an offset can be created between the first web and the second web using the arrangement illustrated in FIG. 4. In particular, by having separate and individual travel paths to the web transport apparatus, each travel path can be adjusted so that an offset can be created in the leading edges of the webs.

In addition to offsetting the webs and/or creating a static charge between the webs, there are other various ways in order to removably bond the webs together. For instance, in one embodiment, the perforation station may create enough web bonding to prevent any fly back problems. In another embodiment, a light adhesive may be applied between the webs at strategic locations, such as adjacent to the leading edge of each web. In still another embodiment, embossments near the leading edge of each tissue web may create sufficient bonding to prevent the webs from separating as they are conveyed on the web transport apparatus.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed:

1. A method for forming spirally wound rolls comprising:
- placing a first tissue web on top of a second tissue web;
- conveying the first tissue web and the second tissue web downstream in a superimposed relationship;
- separating the first tissue web from the second tissue web and feeding the first tissue web to a first winding device and feeding the second tissue web to a second winding device; and
- winding the first tissue web on the first winding device and winding the second tissue web on the second winding device simultaneously to form respective spirally wound rolls.

2. A method as defined in claim 1, wherein the first tissue web and the second tissue web are conveyed downstream by a conveying device that applies a suction force to the tissue webs.

3. A method as defined in claim 2, wherein the first tissue web is positioned offset with respect to the second tissue web on the conveying device such that a leading edge of the first tissue web overlaps and extends beyond a leading edge of the second tissue web.

4. A method as defined in claim 1, wherein the first tissue web and the second tissue web are bonded together in a removable manner when conveyed downstream.

5. A method as defined in claim 4, wherein the first tissue web is bonded to the second tissue web by a static force.

6. A method as defined in claim 1, wherein the first tissue web and the second tissue web are calendered as the webs are conveyed downstream in a superimposed relationship.

7. A method as defined in claim 1, wherein the first tissue web and the second tissue web are each cut periodically as spirally wound rolls from each tissue web are formed and new spirally wound rolls are started.

8. A method as defined in claim 7, wherein the first tissue web and the second tissue web are cut while in a superimposed relationship.

9. A method as defined in claim 8, wherein the first tissue web and the second tissue web are periodically perforated to form cross-directional perforation lines on each web as the webs are formed into the spirally wound rolls.

10. A method as defined in claim 7, wherein the first tissue web and the second tissue web are cut separately.

11. A method as defined in claim 1, wherein the first tissue web and the second tissue web are periodically perforated to form cross-directional perforation lines on each web as the webs are formed into the spirally wound rolls.

12. A method as defined in claim 11, wherein the tissue webs are perforated prior to being placed in a superimposed relationship.

13. A method as defined in claim 12, wherein the first tissue web and the second tissue web are each cut periodically as spirally wound rolls from each tissue web are formed and new spirally wound rolls are started, and wherein each tissue web is cut separately without the webs being in a superimposed relationship.

14. A system for forming spirally wound rolls comprising:
- a first unwind device for unwinding a first tissue web and a second unwind device for unwinding a second tissue web;
- a web transport apparatus for conveying the first tissue web and the second tissue web downstream from the unwind stations, the web transport apparatus being configured to receive the first tissue web and the second tissue web simultaneously in a superimposed relationship;
- a plurality of winding modules positioned along the web transport apparatus, the system including at least a first winding module for receiving the first tissue web and a second winding module for receiving the second tissue web, the winding modules for simultaneously forming spirally wound rolls from the respective tissue webs;
- at least one perforation station for forming cross-directional perforation lines at periodic intervals on the first tissue web and on the second tissue web; and
- at least one cutting device positioned upstream from the winding modules for cutting the first tissue web and the second tissue web periodically as spirally wound rolls are formed.

15. A system as defined in claim 14, wherein the system includes a single perforation station and a single cutting device, the perforation station being positioned so as to perforate the first and second tissue webs simultaneously while the webs are in a superimposed relationship, the cutting device being configured to cut the first tissue web and the second tissue web simultaneously also while the webs are in a superimposed relationship.

16. A system as defined in claim 14, further comprising a static induction device, the static induction device being configured to impart a static charge into at least one of the tissue webs for causing the tissue webs to bond together in a removable fashion as the webs are conveyed by the web transport apparatus.

17. A system as defined in claim 14, wherein the system includes a first perforation station for perforating the first tissue web and a second perforation station for perforating the second tissue web, the system further including a first cutting device for cutting the first tissue web and a second cutting device for cutting the second tissue web, the perforation stations and the cutting devices being positioned prior to the web transport apparatus where the tissue webs are placed in a superimposed relationship.

18. A system as defined in claim 14, wherein the web transport apparatus includes a conveying device that applies a suction force to the tissue webs as the tissue webs are conveyed downstream in a superimposed relationship.

19. A system as defined in claim 18, wherein the system includes a first travel path for a first tissue web and a second travel path for a second tissue web, and wherein the first travel path and the second travel path have different lengths that cause a leading edge of the first tissue web to overlap and extend beyond a leading edge of the second tissue web when the tissue webs are cut.

20. A system as defined in claim 19, wherein the first travel path and the second travel path are positioned prior to a location where the tissue webs are placed in a superimposed relationship.

21. A system as defined in claim 19, wherein the first travel path and the second travel path are located after where the tissue webs have been placed in a superimposed relationship.

* * * * *